US008388378B2

(12) United States Patent
Ratzlaff et al.

(10) Patent No.: US 8,388,378 B2
(45) Date of Patent: Mar. 5, 2013

(54) ELECTRICAL CONNECTOR

(75) Inventors: Thomas Dean Ratzlaff, Menlo Park, CA (US); Paul Craig Tally, Santa Clara, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/170,750

(22) Filed: Jun. 28, 2011

(65) Prior Publication Data

US 2013/0005182 A1 Jan. 3, 2013

(51) Int. Cl.
*H01R 13/648* (2006.01)

(52) U.S. Cl. ..... 439/607.01

(58) Field of Classification Search ..... 439/607.01, 439/607.41, 468, 607.49, 904
See application file for complete search history.

(56) References Cited

U.S. PATENT DOCUMENTS

| | | | | |
|---|---|---|---|---|
| 7,670,180 | B2 * | 3/2010 | Gerard et al. | 439/607.01 |
| 8,002,572 | B2 * | 8/2011 | Lu et al. | 439/405 |
| 8,083,545 | B2 * | 12/2011 | Koitabashi et al. | 439/607.01 |
| 8,142,226 | B2 * | 3/2012 | Xiao et al. | 439/607.56 |
| 2010/0184327 | A1 * | 7/2010 | Carpenter et al. | 439/607.01 |
| 2010/0248540 | A1 * | 9/2010 | Eshima | 439/607.01 |
| 2010/0317220 | A1 * | 12/2010 | Shen | 439/374 |
| 2011/0312217 | A1 * | 12/2011 | Xiao et al. | 439/607.23 |

* cited by examiner

*Primary Examiner* — Jean F Duverne

(57) ABSTRACT

An electrical connector includes a terminal subassembly having inserts holding terminals. The terminals extend between a mating end and a cable end. The cable end is configured to be terminated to corresponding wires of a cable. A front shell surrounds a front portion of the terminal subassembly. The front shell provides electrical shielding around the mating ends of the terminals. The front shell is configured to be mated to a mating connector. A back shell surrounds a rear portion of the terminal subassembly. The back shell provides electrical shielding around the cable ends of the terminals. The back shell is configured to be terminated to an overbraid of the cable. The back shell includes a plurality of contacts that extend from a front of the back shell. The contacts engage, and are electrically connected to, the front shell.

20 Claims, 4 Drawing Sheets

ELECTRICAL CONNECTOR

BACKGROUND OF THE INVENTION

The subject matter herein relates generally to electrical connectors, and more particularly, to shielded electrical connectors.

Electrical connectors, such as copper based electrical connectors or fiber optic connectors, are known and in use in many different types of applications, such as aerospace, military or automotive applications. Some electrical connectors use removable inserts to hold conductors. However, during a typical harness installation process or during a typical harness assembly process, unsupported conductors may be damaged. The conductors may also be damaged as the insert is installed into a connector. Additionally, if the conductors are improperly positioned within the connector, the conductors may be damaged during mating with the mating connector. Additionally, in some connectors, multiple inserts may be installed into a connector body, and control of inserts during the installation process may be problematic.

Furthermore, in some applications, shielding is used extensively and requires specific installation and rework knowledge, tools and skills. Typically reworking requires destructive means to the retention component of the connector to the cable (e.g. the tinel ring, bandstrap, etc.) and new part replacement. Additionally, electrical continuity of the electrical shield from the cable to the connector may be difficult to achieve and require costly design and components to achieve.

A need remains for an electrical connector that provides a robust interface between the overbraid of the cable and the insert assembly of the electrical connector. A need remains for an electrical connector that may be assembled in a cost effective and reliable manner and/or may be disassembled without detriment or destruction of the components of the electrical connector.

BRIEF DESCRIPTION OF THE INVENTION

In one embodiment, an electrical connector is provided having a terminal subassembly that includes inserts holding terminals. The terminals extend between a mating end and a cable end. The cable end is configured to be terminated to corresponding wires of a cable. A front shell surrounds a front portion of the terminal subassembly. The front shell provides electrical shielding around the mating ends of the terminals. The front shell is configured to be mated to a mating connector. A back shell surrounds a rear portion of the terminal subassembly. The back shell provides electrical shielding around the cable ends of the terminals. The back shell is configured to be terminated to an overbraid of the cable. The back shell includes a plurality of contacts that extend from a front of the back shell. The contacts engage, and are electrically connected to, the front shell.

In another embodiment, an electrical connector is provided having a terminal subassembly that includes a housing and a plurality of inserts received in the housing. The inserts extend forward from the housing. The inserts hold terminals. The terminals extend between a mating end and a cable end. The cable end is configured to be terminated to corresponding wires of a cable. A front shell surrounds a front portion of the housing and the inserts. The front shell provides electrical shielding around the mating ends of the terminals. The front shell is configured to be mated to a mating connector. A back shell surrounds a rear portion of the housing. The back shell provides electrical shielding around the cable ends of the terminals. The back shell is configured to be terminated to an overbraid of the cable. The back shell includes a plurality of contacts that extend from a front of the back shell. The contacts engage, and are electrically connected to, the front shell.

In a further embodiment, an electrical connector is provided having a terminal subassembly that includes a housing and a plurality of inserts received in the housing. The housing has notches formed therein. The inserts extend forward from the housing. The inserts hold terminals. The terminals extend between a mating end and a cable end. The cable end is configured to be terminated to corresponding wires of a cable. A front shell surrounds a front portion of the housing and the inserts. The front shell provides electrical shielding around the mating ends of the terminals. The front shell is configured to be mated to a mating connector. A back shell surrounds a rear portion of the housing. The back shell provides electrical shielding around the cable ends of the terminals. The back shell is configured to be terminated to an overbraid of the cable. The back shell includes locating tabs that extend therefrom. The locating tabs are received in corresponding notches to locate the housing within the back shell. The back shell includes a plurality of contacts that extend from a front of the back shell. The contacts engage, and are electrically connected to, the front shell.

DETAILED DESCRIPTION OF THE INVENTION

Figure 1:
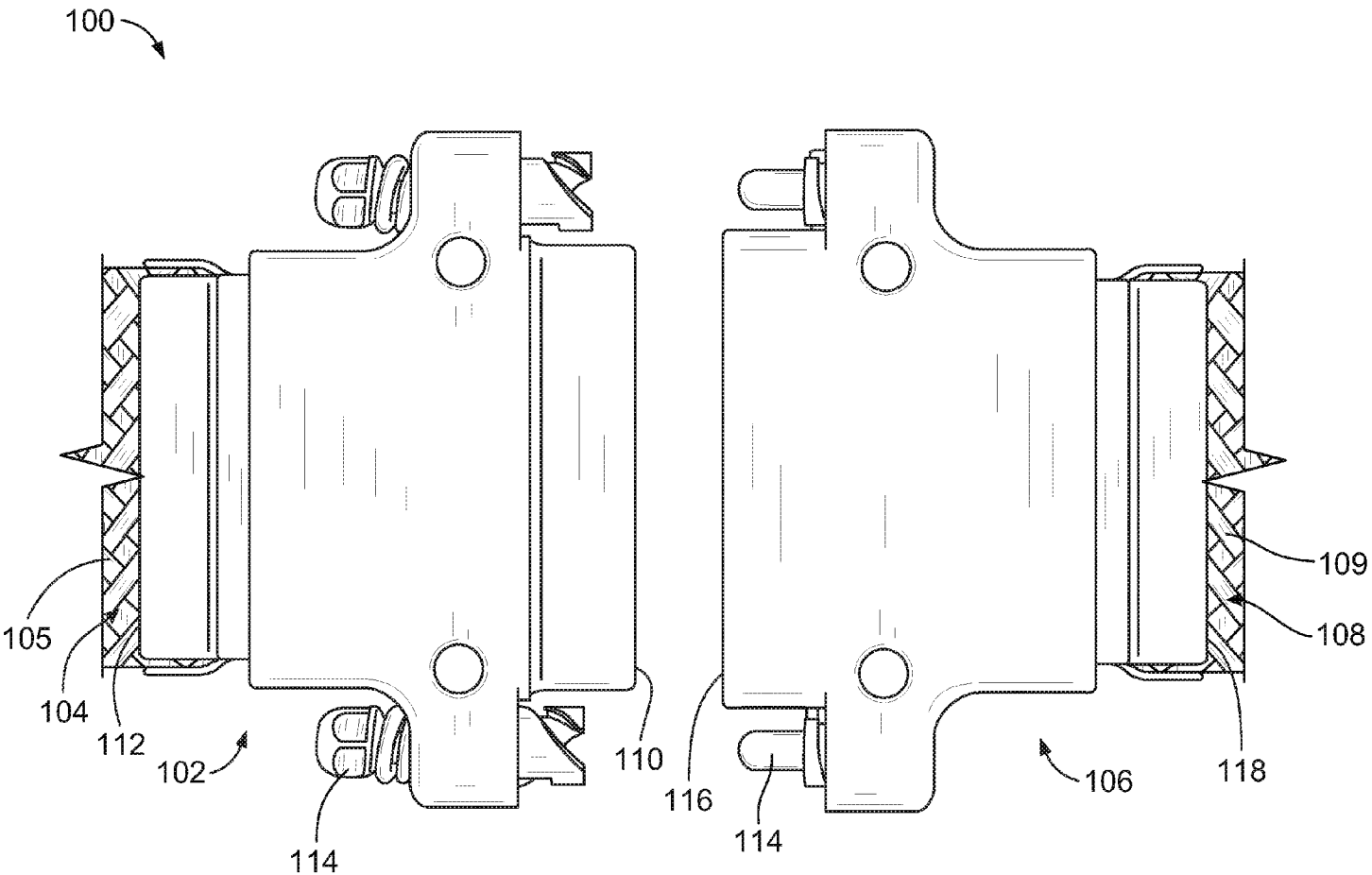
FIG. 1 illustrates an electrical connector system formed in accordance with an exemplary embodiment.

FIG. 1 illustrates an electrical connector system 100 formed in accordance with an exemplary embodiment. The electrical connector system 100 includes an electrical connector 102 provided at an end of a cable 104. The electrical connector system 100 also includes a mating connector 106 provided at an end of a cable 108. The electrical connector 102 is configured to be coupled to the mating connector 106 to transfer signals between the electrical connector 102 and the mating connector 106. Optionally, the electrical connector 102 and/or mating connector 106 may be panel mounted within an electrical component of the electrical connector system 100. The electrical connector 102 is coupled to the mating connector 106 at a separable interface, where the electrical connector 102 may be coupled to, and uncoupled from, the mating connector 106.

The electrical connector 102 includes a front end 110 that is configured to be mated to the mating connector 106. The electrical connector 102 has a cable end 112 that is terminated to the cable 104. In an exemplary embodiment, the electrical connector 102 and the cable 104 provide electrical shielding around the terminals and wires held therein. The electrical connector 102 thus defines a shielded electrical connector. The electrical connector 102 provides shielding from electromagnetic interference (EMI) or from other types of interference and from lightning strikes. The cable 104 includes an electrical shield, such as a braid sock or an overbraid 105, which extends over and electrically shields the cable 104. The overbraid 105 may be a woven metallic braid component or a woven composite fiber that has been plated to provide electrical conductivity, which provides EMI shielding and/or lightning strike protection.

The electrical connector 102 includes fasteners 114 that are configured to secure the electrical connector 102 to the mating connector 106 and/or to a panel. In an alternative embodiment, rather than fasteners 114, the electrical connector 102 may include other securing features to couple the electrical connector 102 to the mating connector 106 and/or the panel, such as latches.

The mating connector 106 includes a front end 116 that is configured to be coupled to the front end 110 of the electrical connector 102. The mating connector 106 includes a cable end 118 that is terminated to the cable 108. The mating connector 106 and the cable 108 provide electrical shielding around the terminals and wires held therein. The cable 108 includes an electrical shield, such as an overbraid 109, which extends over and electrically shields the cable 108. The overbraid 105 may be a woven metallic braid component or a woven composite fiber that has been plated to provide electrical conductivity, which provides EMI shielding and/or lightning strike protection. Optionally, the front end 110 of the electrical connector may be plugged into the front end 116 of the mating connector 106. Alternatively, the front end 116 of the mating connector 106 may be plugged into the front end 110 of the electrical connector 102.

Figure 2:
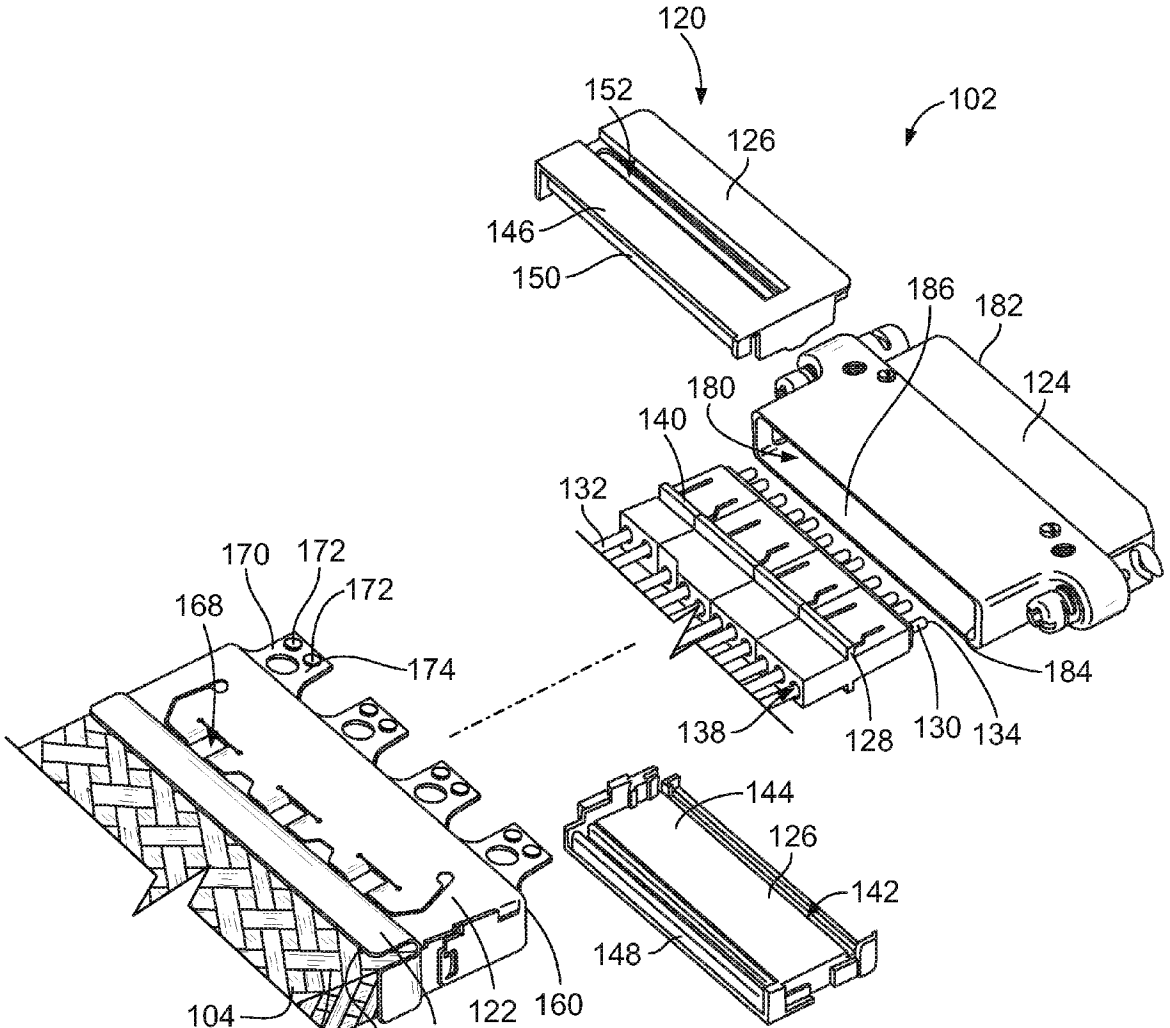
FIG. 2 is an exploded view of the electrical connector shown in FIG. 1.

FIG. 2 is an exploded view of the electrical connector 102. The electrical connector 102 includes a terminal subassembly 120, a back shell 122 and a front shell 124.

The terminal subassembly 120 includes a housing 126 that holds a plurality of inserts 128. Each insert 128 holds a plurality of terminals 130. The terminals 130 are terminated to ends of wires 132. Optionally, different types of inserts 128 may be provided within the terminal subassembly 120. Any number of inserts 128 may be used within the terminal subassembly 120.

Each terminal 130 extends between a mating end 134 and a cable end 136 (shown in FIG. 5), which is terminated to the end of the wire 132. The mating ends 134 are configured to be mated with corresponding terminals of the mating connector 106 (shown in FIG. 1). The terminals 130 may be copper based electrical terminals or fiberoptic terminals, depending on the particular application. The number and positioning of the terminals 130 within the inserts 128 depends on the particular application. Any number of terminals may be held within each insert 128.

Each insert 128 includes a body extending between a front and a rear with terminals channels 138 extending between the front and the rear. The terminals 130 are received in the terminal channels 138. The wires 132 extend rearward from the terminal channels 138. Optionally, the mating ends 134 may extend forward of the front of the insert 128.

In an exemplary embodiment, the body of the insert 128 is manufactured from a dielectric material. Optionally, at least a portion of the body of the insert 128 may be metalized or have a metal shield surrounding such portion to provide electrical shielding for the terminals 130.

The body of the insert 128 includes one or more locating features 140 configured to engage the housing 130 to locate the inserts 128 within the housing 130. In the illustrated embodiment, the locating feature 140 constitutes a flange extending outward from the insert 128 that is configured to be received in a corresponding locating feature 142, represented by a channel, in the housing 126. In alternative embodiments, the locating features 140 may be channels or grooves in the body of the insert 128 that receives tabs or protrusions extending from the housing 126.

The housing 126 is a two part housing having a base 144 and a cover 146. In an exemplary embodiment, the base 144 and the cover 146 may be identical to one another such that the two pieces of the housing 126 are hermaphroditic, to reduce the part count of the electrical connector 102 and thus reduce the overall of the electrical connector 102. The inserts 128 are configured to be positioned between the base 144 and the cover 146. The base 144 is coupled to the cover 146 around the inserts 128 to form the housing 126. The locating features 142 interface with the locating features 140 of the inserts 128 to locate the inserts 128 within the housing 126.

In an exemplary embodiment, the base 144 includes a lower cable clamp 148 and the cover 146 includes an upper cable clamp 150. The wires 132 extending rearward of the inserts 128 are captured between the lower and upper cable clamps 148, 150 when the lower and upper cable clamps 148, 150 are coupled together. Optionally, the lower and upper cable clamps 148, 150 may be cushions manufactured from a deformable material, such as a foam or rubber material that securely holds the wires 132 therebetween. The lower and upper cable clamps 148, 150 may provide strain relief on the wires 132. The lower and upper cable clamps 148, 150 may provide sealing for the electrical connector 102.

The housing 126 includes one or more notches 152 formed therein. In the illustrated embodiment, the notches 152 are formed in both the bottom surface defined the base 144 and the top surface defined by the cover 146. Optionally, the notches 152 may be elongated and extend almost entirely laterally across the base 144 and cover 146. In alternative embodiments, multiple individual notches 152 may be provided in the base 144 and multiple individual notches 152 may be provided in the cover 146. The notches 152 receive portions of the back shell 122 to axially position the terminal subassembly 120 within the back shell 122.

The back shell 122 is manufactured from a conductive material, such as a metal material, a plated composite material, and the like. Optionally, the back shell 122 may be stamped and formed. The back shell 122 extends between a front 160 and a rear 162. The rear 162 is terminated to an overbraid 105 of the cable 104. For example, the rear 162 may be soldered, welded, or otherwise mechanically and electrically connected to the overbraid 105. Optionally, the back shell 122 may include rearward extensions 166 that are flared outward and extend rearward from the back shell 122. The rearward extensions 166 may be soldered or welded to the shielding material of the overbraid 105.

The back shell 122 includes locating tabs 168 extending inward therefrom. The locating tabs 168 may be received in the notches 152 to secure the terminal subassembly 120 within the back shell 122. Optionally, the locating tabs 168 may be moveably received within the notches 152 such that the housing 126 may float laterally, such as in the direction of arrow A, within the back shell 122.

The back shell 122 includes a plurality of contacts 170 extending forward from the front 160 of the back shell 122. The contacts 170 are configured to engage the front shell 124 to electrically connect the back shell 122 and the front shell 124 at multiple points of contact. The contacts 170 include protrusions 172 extending from outer surfaces 174 to engage the front shell 124. Any number of contacts 170 may be provided depending on a particular application. In the illustrated embodiment, the contacts 170 extend from the front 160 at both the top and the bottom of the back shell 122, with four contacts 170 provided along the top and four contacts 170 provided along the bottom. Each contact 170 includes two protrusions 172 such that a total of sixteen points of contact are provided between the contacts 170 of the back shell 122 and the front shell 124. More or less protrusions 172 and/or contacts 170 may be provided in alternative embodiments.

Having multiple points of contacts between the back shell 122 and front shell 124 creates an effective electrical path between the back shell 122 and front shell 124. For example, having multiple points of contact reduces the DC resistance and/or the DC load across the interface, which may allow the electrical connector 102 to perform better in certain situations, such as during surges from a lightning strike.

The front shell 124 includes a cavity 180 extending between a front 182 and a rear 184. The cavity 180 is defined by an inner surface 186. The terminal subassembly 120 and back shell 122 are configured to be received within the cavity 180. The front shell 124 is manufactured from a conductive material, such as a metal material or a composite material. The front shell 124 provides electrical shielding around the terminal subassembly 120. The front shell 124 is configured to be mated to the mating connector 106 (shown in FIG. 1). The fasteners 114 are coupled to the front shell 124 along opposite sides of the front shell 124.

Figure 3:
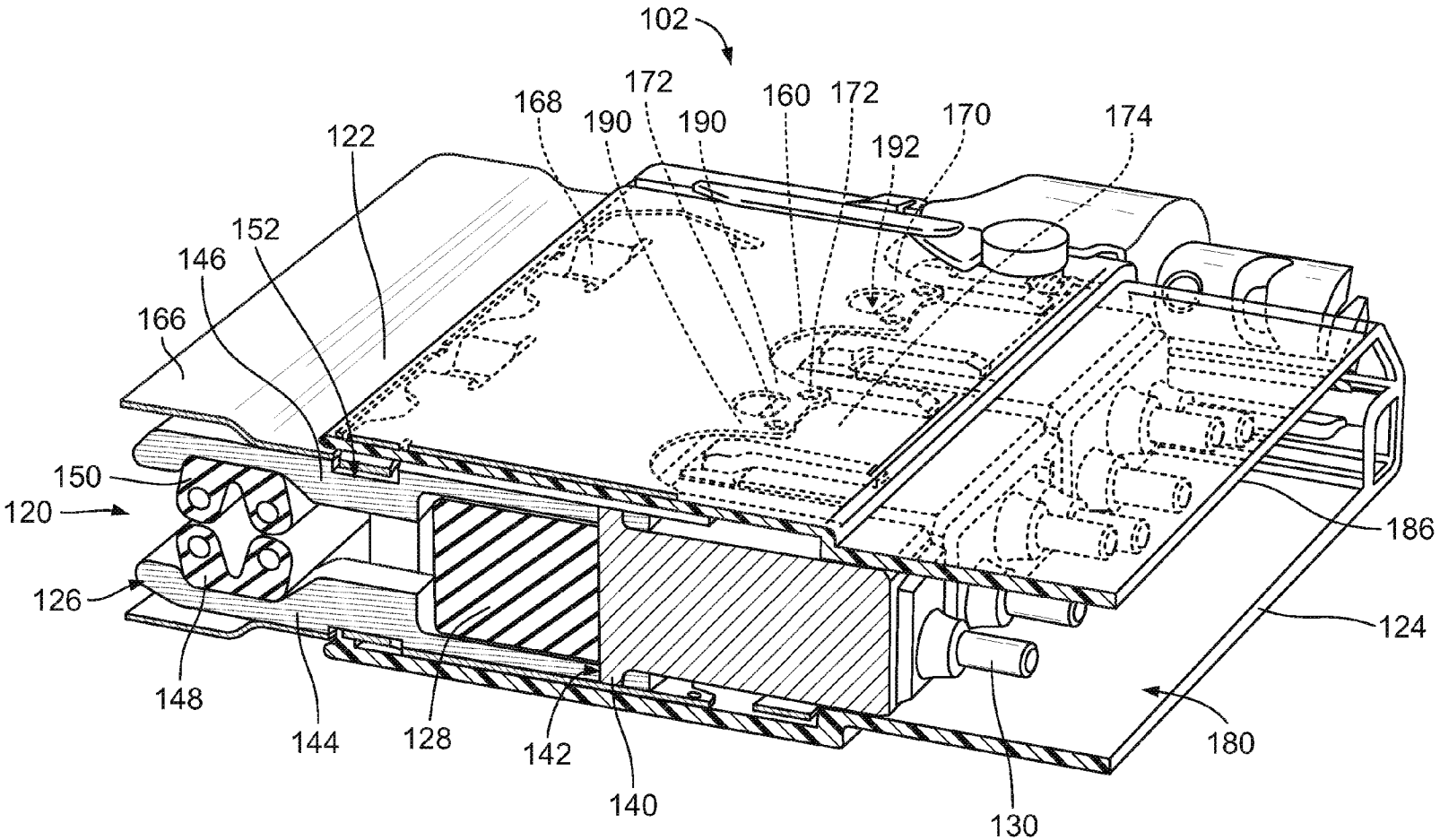
FIG. 3 is a partial sectional view of the electrical connector shown in FIG. 1.

FIG. 3 is a partial sectional view of the electrical connector 102. When assembled, the terminals 130 are loaded into the inserts 128. The inserts 128 are captured between the base 144 and the cover 146 of the housing 126. The inserts 128 are held within the housing 126 using the locating features 140, 142. For example, the locating features 140 of the inserts 128 are received within the locating features 142 of the housing 126 to hold the axial and/or lateral position of the inserts 128 with respect to the housing 126. Portions of the inserts 128 extend forward from the housing 126.

The terminal subassembly 120 is received within the back shell 122. The back shell 122 surrounds a rear portion of the housing 126 and provides electrical shielding around portions of the terminals 130, such as the cable ends 136 (shown in FIG. 5) of the terminals 130. When the terminal subassembly 120 is loaded into the back shell 122, the locating tabs 168 of the back shell 122 are received in the notches 152 of the housing 126. The locating tabs 168 hold the axial position (e.g. from front to back) of the housing 126 with respect to the back shell 122. The locating tabs 168 may be snapped into place within the notches 152 and do not require any special tools or separate fasteners or securing means to secure the housing 126 within the back shell 122. In an exemplary embodiment, because the notches 152 are elongated, the housing 126 is able to float laterally (e.g., from side to side) within the back shell 122. Such floating allows for compliance of the positions of the terminals 130 for mating with the mating connector 106 (shown in FIG. 1).

When assembled, the overbraid 105 (shown in FIG. 2) may be positioned between the rearward extensions 166 and the housing 126. The wires 132 (shown in FIG. 2) may extend directly into the housing 126 and be captured between the lower and upper cable clamps 148, 150. The wires 132 may extend from the lower and upper cable clamps 148, 150 directly into the inserts 128.

The terminal subassembly 120 and back shell 122 are received within the cavity 180 of the front shell 124 during assembly. The contacts 170 are cantilevered from the front 160 of the back shell 122 and are configured to engage the inner surface 186 of the front shell 124 to make electrical contact between the back shell 122 and the front shell 124. The contacts 170 are biased against the front shell 124 to maintain engagement therewith. For example, the contacts 170 may include spring arms 190 that may be at least partially deflected when the back shell 122 is loaded into the front shell 124. Such deflection causes the contacts 170 to be biased against the inner surface 186. The protrusions 172 constitute bumps or raised surfaces that extend from the outer surfaces 174 of the contacts 170. The protrusions 172 define the points of contact between the contacts 170 and the front shell 124. The protrusions 172 may cause the spring arms 190 to be deflected to create a spring force against the inner surface 186 to maintain engagement between the contacts 170 and front shell 124.

In an exemplary embodiment, the contacts 170 include openings 192 between the spring arms 190. Spring arms 190 are provided on both sides of the openings 192. Having the openings 192 allows the opposites sides of the contacts 170 to operate independently and thus provide a different, independent spring force at both protrusions 172 at the opposite sides of the contacts 170.

Figure 4:
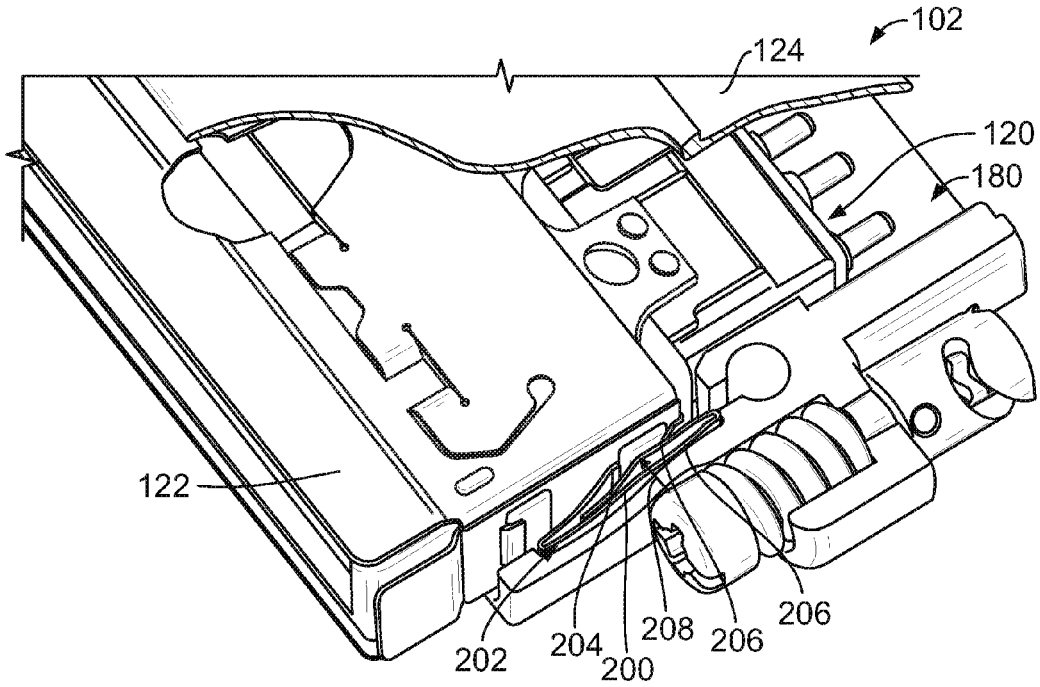
FIG. 4 is a partial sectional view of the electrical connector shown in FIG. 1.

FIG. 4 is a partial sectional view of the electrical connector 102 with a portion of the front shell 124 removed to show the terminal subassembly 120 and back shell 122. A shield clip 200 is received in a compartment 202 in the front shell 124. The shield clip 200 is positioned between the front shell 124 and the back shell 122. The shield clip 200 includes a latch 204 that is configured to engage the back shell 122 to hold the back shell 122 in the front shell 124.

The shield clip 200 has spring arms 206 that engage the front shell 124 and the back shell 122 to laterally position the back shell 122 within the front shell 124. The spring arms 206 are generally forced apart from each other to provide a spring force 208 against the back shell 122. The spring force 208 generally pushes the side of the back shell 122 away from the side of the front shell 124. A second shield clip (not shown) is provided on the other side of the front shell 124 which provides a spring force in the opposite direction. The shield clips 200 tend to center the terminal subassembly 120 and back shell 122 within the cavity 180 of the front shell 124. The terminal subassembly 120 and the back shell 122 are configured to float laterally against one or the other spring force 208 to shift the terminals 130 from side to side for mating with the mating connector 106 (shown in FIG. 1). The shield clips 200 generate a normal force between the back shell 122 and the front shell 124 to create an electrical contact between the back shell 122 and the front shell 124.

Figure 5:
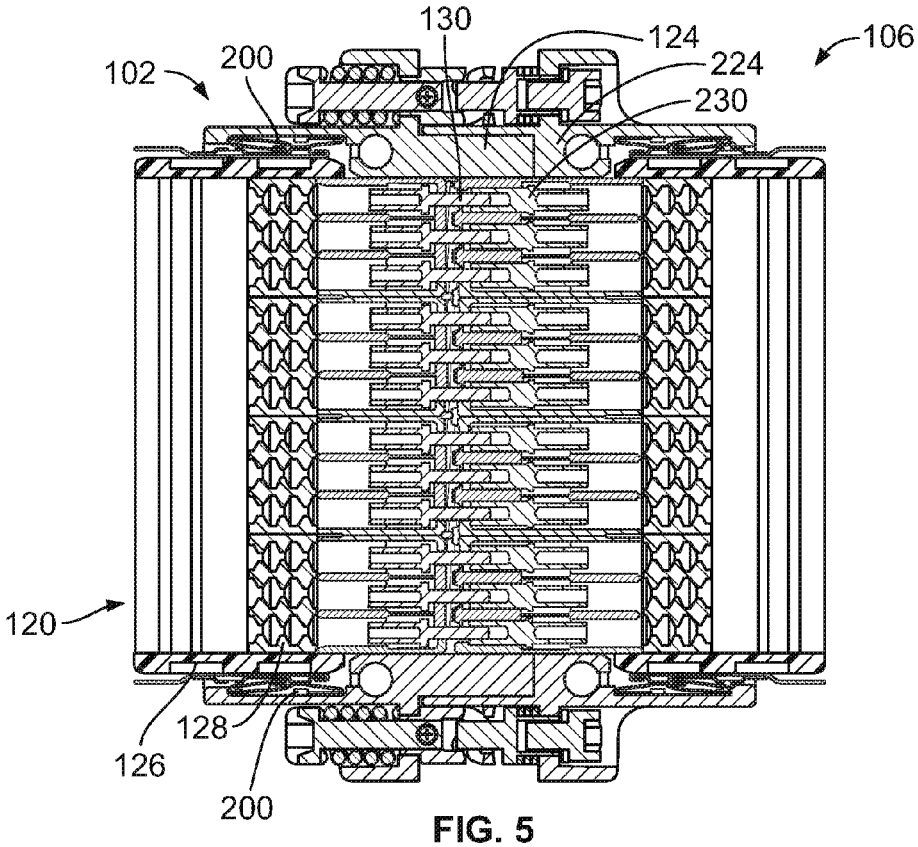
FIG. 5 is a cross sectional view of the electrical connector shown in FIG. 1.

FIG. 5 is a cross sectional view of the electrical connector 102 mated with the mating connector 106. The front shell 124 is plugged into the mating connector 106 such that the terminals 130 are mated with terminals 230 of the mating connector 106. Because the inserts 128 are able to float laterally within the housing 126 and because the terminal subassembly 120 is configured to float laterally within the front shell 124 using the shield clips 200, the lateral positions of the terminals 130 with respect to the terminals 230 may be shifted during mating to align the terminals 130 and the terminals 230 to reduce damage to the terminals 130 and/or 230. When the electrical connector 102 and the mating connector 106 are mated together, the front shell 124 engages, and is electrically connected to, a front shell 224 of the mating connector 106 to maintain electrical continuity and electrical shielding between the electrical connector 102 and the mating connector 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a terminal subassembly comprising inserts holding terminals, the terminals extending between a mating end and a cable end, the cable end being configured to be terminated to corresponding wires of a cable;

a front shell circumferentially surrounding a cavity, the cavity receiving the terminal subassembly such that the front shell surrounds a front portion of the terminal subassembly, the front shell providing electrical shielding around the mating ends of the terminals, the front shell being configured to be mated to a mating connector; and a back shell separate and discrete from the front shell, the back shell being received in the cavity of the front shell, the back shell surrounding a rear portion of the terminal subassembly, the back shell providing electrical shielding around the cable ends of the terminals, the back shell being configured to be terminated to an overbraid, the back shell including a plurality of contacts integral with the back shell and extending from a front of the back shell, the contacts being loaded into the cavity such that the contacts define a separable mating interface engaging, and being electrically connected to, the front shell.

2. The electrical connector of claim 1, wherein the contacts include protrusions extending from outer surfaces of the contacts, the protrusions being loaded into the front shell during assembly and engaging the front shell when assembled.

3. The electrical connector of claim 1, wherein the back shell includes a stamped and formed body with the contacts being stamped and formed with the body of the back shell and cantilevered from the front of the back shell, the contacts being biased against the front shell to maintain engagement therewith.

4. The electrical connector of claim 1, wherein the cavity is defined by an inner surface, the terminal subassembly and back shell being received in the cavity, the contacts engaging the inner surface.

5. The electrical connector of claim 1, wherein the back shell includes locating tabs engaging the terminal subassembly to position the terminals with respect to the back shell.

6. The electrical connector of claim 1, wherein the back shell includes at least one contact aligned with each insert.

7. The electrical connector of claim 1, wherein the back shell includes a top and a bottom, the top and bottom extending along opposite ends of all of the inserts, the back shell having contacts extending from the top and contacts extending from the bottom.

8. The electrical connector of claim 1, further comprising a shield clip received in the front shell, the shield clip being positioned between the front shell and the back shell, the shield clip having a latch engaging the back shell, the latch holding the back shell in the front shell.

9. The electrical connector of claim 1, further comprising a shield clip received in the front shell, the shield clip being positioned between the front shell and the back shell, the shield clip having spring arms engaging the front shell and the back shell to laterally position the back shell within the front shell, the shield clip allowing the terminal subassembly to float laterally within the front shell.

10. The electrical connector of claim 1, wherein the terminal subassembly includes a housing holding the inserts, the inserts being located within the housing, the housing received in the back shell, the housing being located within the back shell, the electrical connector further comprising shield clips positioned between the front shell and the back shell to laterally position the back shell, housing and inserts within the front shell.

11. An electrical connector comprising:

a terminal subassembly comprising a housing and a plurality of inserts received in the housing, the inserts extending forward from the housing, the inserts holding terminals, the terminals extending between a mating end and a cable end, the cable end being configured to be terminated to corresponding wires of a cable;

a front shell circumferentially surrounding a cavity extending between a front and a rear of the front shell, the cavity receiving the terminal subassembly and housing such that the front shell surrounds a front portion of the housing and the inserts, the front shell providing electrical shielding around the mating ends of the terminals, the front shell being configured to be mated to a mating connector; and a back shell separate and discrete from the front shell and surrounding a rear portion of the housing, the back shell and housing being loaded into the cavity of the front shell in a loading direction through the rear of the front shell, the back shell providing electrical shielding around the cable ends of the terminals, the back shell being configured to be terminated to an overbraid of the cable, the back shell including a plurality of contacts integral with the back shell and extending from a front of the back shell, the contacts being loaded into the cavity such that the contacts define a separable mating interface engaging, and being electrically connected to, the front shell.

12. The electrical connector of claim 11, wherein the contacts include protrusions extending from outer surfaces of the contacts, the protrusions engaging the front shell.

13. The electrical connector of claim 11, wherein the contacts are cantilevered from the front of the back shell, the contacts being biased against the front shell to maintain engagement therewith.

14. The electrical connector of claim 11, wherein the cavity is defined by an inner surface, the terminal subassembly and back shell being received in the cavity, the contacts engaging the inner surface.

15. The electrical connector of claim 11, wherein the back shell includes locating tabs engaging the housing to position the housing with respect to the back shell.

16. The electrical connector of claim 11, wherein the housing includes a base and a cover separately provided from the base, the base and the cover each having a wire clamp cushion, the wire clamp cushions of the base and cover being configured to hold the wires therebetween.

17. An electrical connector comprising:

a terminal subassembly comprising a housing and a plurality of inserts separate and discrete from the housing, the inserts being received in the housing, the housing having notches formed therein, the inserts extending forward from the housing, the inserts holding terminals, the terminals extending between a mating end and a cable end, the cable end being configured to be terminated to corresponding wires of a cable;

a front shell circumferentially surrounding a cavity extending between a front and a rear of the front shell, the cavity receiving the terminal subassembly and housing such that the front shell surrounds a front portion of the housing and the inserts, the front shell providing electrical shielding around the mating ends of the terminals, the front shell being configured to be mated to a mating connector; and a back shell separate and discrete from the front shell and surrounding a rear portion of the housing, the back shell providing electrical shielding around the cable ends of the terminals, the back shell being configured to be terminated to an overbraid of the cable, the back shell including locating tabs extending therefrom, the locating tabs being received in corresponding notches to locate the housing within the back shell, the back shell and housing being loaded into the cavity of the front shell in a loading direction through the rear of the front shell, the back shell including a plurality of contacts integral with the back shell and extending from a front of the back shell, the contacts being loaded into the cavity such that the contacts define a separable mating interface engaging, and being electrically connected to, the front shell.

18. The electrical connector of claim 17, wherein the contacts include protrusions extending from outer surfaces of the contacts, the protrusions engaging the front shell.

19. The electrical connector of claim 17, wherein the contacts are cantilevered from the front of the back shell, the contacts being biased against the front shell to maintain engagement therewith.

20. The electrical connector of claim 17, wherein the cavity is defined by an inner surface, the terminal subassembly and back shell being received in the cavity, the contacts engaging the inner surface.

* * * * *